US007437777B2

(12) United States Patent
Marquardt

(10) Patent No.: US 7,437,777 B2
(45) Date of Patent: Oct. 21, 2008

(54) MODIFIED HEAD COVERING

(75) Inventor: Shelby Marquardt, Houston, TX (US)

(73) Assignee: Blue Sky Scrubs, LLC, Austin, TX (US)

( * ) Notice: Subject to any disclaimer, the term of this patent is extended or adjusted under 35 U.S.C. 154(b) by 0 days.

(21) Appl. No.: 11/443,142

(22) Filed: May 26, 2006

(65) Prior Publication Data

US 2006/0272073 A1 Dec. 7, 2006

Related U.S. Application Data

(60) Provisional application No. 60/686,199, filed on Jun. 1, 2005, provisional application No. 60/704,716, filed on Aug. 2, 2005.

(51) Int. Cl.
*A42B 1/04* (2006.01)

(52) U.S. Cl. ..... 2/202; 2/204; 2/171

(58) Field of Classification Search ..... 2/174, 2/202, 204, 203, 172, 171, 207, 181; 132/273, 132/274, 212; D2/867, 870, 874, 878, 880
See application file for complete search history.

(56) References Cited

U.S. PATENT DOCUMENTS

| | | | | | |
|---|---|---|---|---|---|
| 43,591 | A | * | 7/1864 | Landenberger | 2/204 |
| D133,490 | S | * | 8/1942 | Burns | D2/867 |
| D135,323 | S | * | 3/1943 | Liberatore | D2/883 |
| 2,666,923 | A | * | 1/1954 | Berg | 2/174 |
| 2,730,722 | A | | 1/1956 | Colangelo | |
| 2,817,090 | A | | 12/1957 | Toellner | |
| 2,869,135 | A | * | 1/1959 | Wagenfeld | 2/174 |
| 3,555,565 | A | | 1/1971 | Zimmon et al. | |
| 3,943,575 | A | | 3/1976 | Bolker | |
| 4,453,276 | A | | 6/1984 | Smith et al. | |
| 5,067,174 | A | | 11/1991 | Ritchey et al. | |
| 5,218,723 | A | | 6/1993 | McLaughlin | |
| 5,269,024 | A | | 12/1993 | Wyatt | |
| 5,490,528 | A | * | 2/1996 | Day | 132/200 |
| 5,566,689 | A | | 10/1996 | Yeater | |
| 5,595,199 | A | | 1/1997 | Solomon et al. | |
| 5,878,756 | A | * | 3/1999 | Bilodeau | 132/274 |
| 5,920,909 | A | * | 7/1999 | Ellsworth et al. | 2/171 |
| 6,622,310 | B1 | | 9/2003 | Tsai | |
| 6,735,783 | B2 | | 5/2004 | Phillips | |
| 6,738,986 | B1 | * | 5/2004 | Martin | 2/207 |
| 2005/0144702 | A1 | * | 7/2005 | Whitney | 2/202 |
| 2006/0048277 | A1 | * | 3/2006 | Yeadon | 2/204 |

* cited by examiner

*Primary Examiner*—Amy B Vanatta
(74) *Attorney, Agent, or Firm*—Jackson Walker L.L.P.

(57) ABSTRACT

The modified head covering has a cap portion that resembles typical head caps, as well as a pouch portion attached to the rear of the cap. This head covering allows a user having long hair to safely conceal his or her hair within the pouch portion at the rear of the head covering. The pouch portion can be cinched tightly into a "sack" or "pouch" shape through the use of a ribbon, an elastic band, or other devices. Once the pouch portion is constricted, the hair is safely concealed and kept off of the nape of the neck. The head covering can be made of a variety of fabrics with a number of patterns or colors. The modified head covering is particularly suited to medical personnel working in sterile environments, but it is useful for anyone with long hair who must conceal his or her hair inside a cap.

9 Claims, 3 Drawing Sheets

MODIFIED HEAD COVERING

This application claims priority to U.S. Provisional Patent Application Ser. No. 60/686,199, entitled "Head covering," filed on Jun. 1, 2005, and U.S. Provisional Patent Application Ser. No. 60/704,716, entitled "Head covering II," filed on Aug. 2, 2005, the entire content of which are hereby incorporated by reference.

BACKGROUND

This invention relates to head coverings for use by individuals in sterile environments, such as during surgical procedures. In particular, this invention relates to scrub hats having a modified design which permits a user with long hair to tuck his or her hair into a rear pouch having a drawstring.

Many professions require employees to conceal or cover their hair during the performance of their jobs. Physicians, nurses, technicians, and others who spend time in the operating room are usually required to wear a head covering that conceals all of their hair. Similar hair constraints are also often required of food servers, cooks, chefs, factory workers, and other not specifically mentioned herein.

Focusing on the medical profession solely for illustrative purposes, the current state of the art reveals that the hair covering options for individuals with long hair, and particularly women, are few. The current available style is often what is termed a "bouffant" hat, which resembles a shower cap. This style is quite unflattering and bulky. Furthermore, it falls down on the nape of the neck, which can be uncomfortable when dressing in surgical gowns or other attire for a surgery or procedure. Head coverings that fall to the nape of the neck will also often get caught underneath a stethoscope, which must be worn daily around the neck.

People having short hair, and particularly men, have many more desirable options for head coverings. The preferred head covering is slim, form-fitted to the head, and remains off of the nape of the neck. Thus, this head covering is much more comfortable and flattering. Many women and men having long hair would like to wear this type of head covering but cannot due to the shape of the head covering, and because they cannot conceal their hair within it.

What is needed, therefore, is a modified head covering having a slim and form-fitted design that also permits long hair to be concealed and held off of the nape of the neck.

SUMMARY

The current invention pertains to a modified head covering. This head covering device or apparatus includes an addition of fabric on the back to cover any hair which might extend outside of the main portion of the head covering. The additional fabric on the posterior portion of the head covering is circular in shape and extends from the portion of the head covering that covers the crown of the head and the sides of the head. This circular extension may form a pouch in which hair can be concealed. The pouch can be formed through the use of a ribbon that passes through a hem at the edges of the circular portion of fabric, or through any suitable means, such as elastic. The end result is a head covering that is slim, fitted, and that fully conceals the individual's hair and holds it off of the nape of the neck. The fabric used to create the head covering can have any desirable pattern, either feminine, masculine, or neutral, and can be of any suitable material, including disposable material.

DETAILED DESCRIPTION OF PREFERRED EMBODIMENTS

Figure 1:
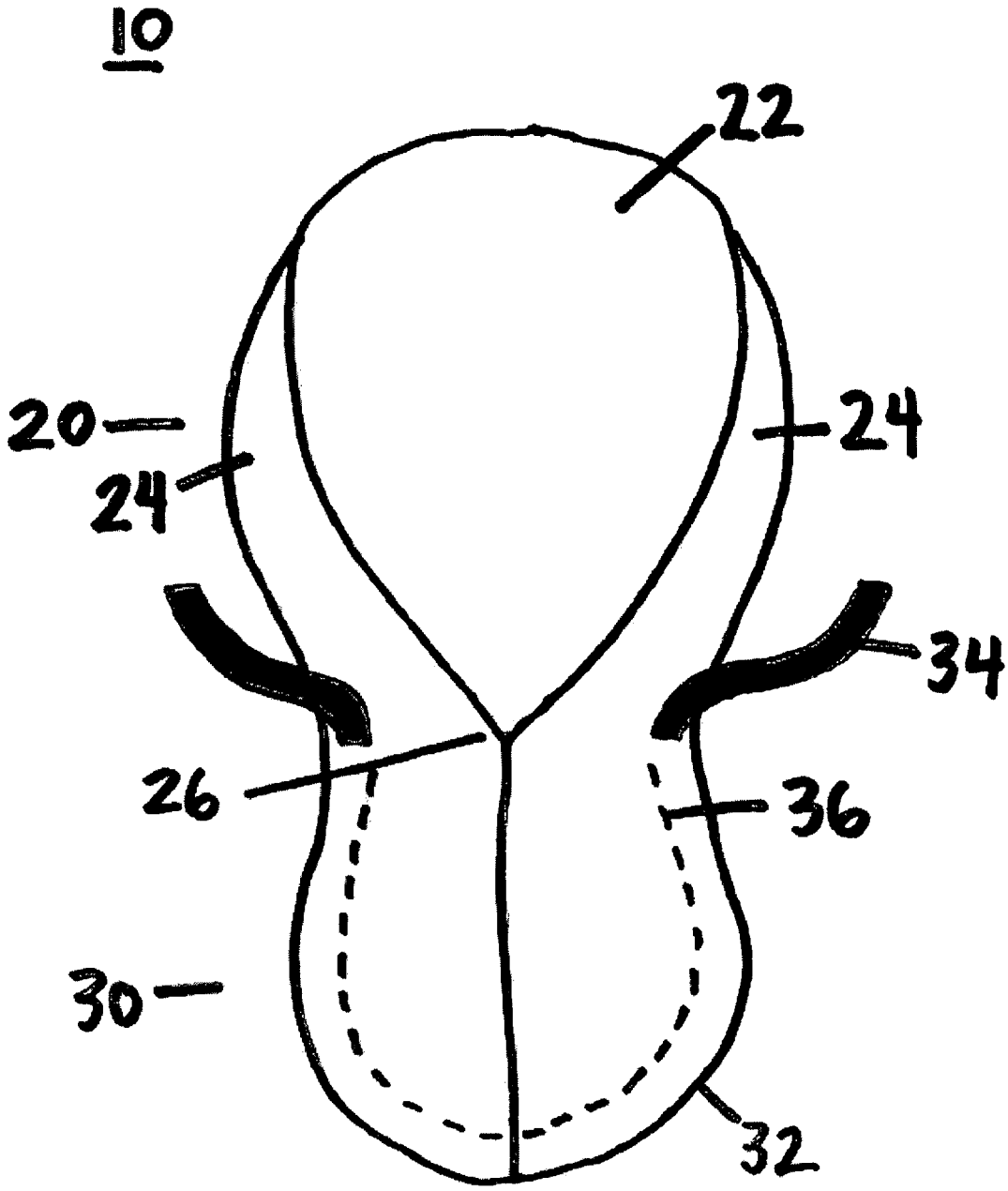
FIG. 1 is a top view of a modified head covering having a pouch portion that is flat and has not been cinched.

One aspect of the current invention pertains to a modified scrub hat which permits a wearer having long to conceal and cover the hair in an integral pouch. The modified head covering is slim and fitted to the head but contains an additional portion of fabric on the posterior section that can contain long hair, such as hair that will cover the nape of the neck of the person, and keep it off of the nape of the neck.

The modified head covering of the present invention comprises a cap portion for covering the top of the head and an integrally connected pouch portion attached to the rear of the cap portion. The pouch portion can be tightened in order to secure the hair.

The cap portion of the head covering is of any shape that is suitable for a head covering. Preferably, the cap portion is shaped like a typical scrub hat having a top surface, one or more side panels, and a rear portion. Preferably, the side panels of the cap portion are deep, or long, enough to at least partially cover the upper tips of the ears of the person, or individual, wearing the scrub. The cap portion may be secured to the head by any suitable means, such as through drawstrings, elastic, buttons, snaps, and hook and loop fasteners (more commonly known as Velcro® fasteners). In a preferred example, the cap portion is specially fitted to the size of the head and may come in a variety of sizes, such as small, medium, and large. As a matter of personal taste or style, the fabric of the head covering can have any of a limitless number of patterns or colors.

The pouch portion of the head covering is preferably circular in shape, although any suitable shape is acceptable, and extends downward from the rear of the cap portion. Without modification, the pouch portion is simply a flap of fabric. In order to perform its function and secure the hair, the pouch portion has a cinchable border. In a preferred example, the cinchable border is created through the use of a ribbon that passes through a hem at the edge of the pouch portion. When this ribbon is pulled tight, the fabric of the pouch portion gathers to create what looks like a "sack" or "pouch." The individual using the head covering places his or her hair in the pouch portion, crosses the two ends of the ribbon under the pouch portion, and then cinches it tight by tying the ribbon over the top of the pouch portion. This motion can also tighten the head covering so that it conforms to the size of the wearer's head. In alternative embodiments, the cinchable border of the pouch portion can be created through the use of an elastic band or any suitable device that will allow the pouch to constrict and securely hold the hair off of the neck. The pouch is adjustable such that it can accommodate any length of hair, for example, hair that extends only 1 inch from their scalp, an extreme length of 5 feet of hair, and all lengths in between. This is possible because the pouch portion of the hat is cinchable and can be made as tight or as loose as the wearer desires. Whether the pouch is made small and tight or large and loose, the hat remains secure on the wearer's head.

The modified head covering holds the wearer's hair off of the nape of the neck. This is a desirable quality in the medical profession in particular. When dressing in a surgical gown it is inconvenient and frustrating for the hair or hat to be caught under the gown itself. Furthermore, when not in surgery, many medical professionals wear a stethoscope or a doctors' or lab coat. The current hair coverings on the market do not adequately hold hair off of the nape of the neck, and the hat and hair is again caught under these garments or objects. This is uncomfortable and cumbersome for the wearer. The head covering of this invention serves to alleviate these problems.

The material used for the head covering can be any suitable material, such as cotton, flannel, velvet, terry cloth, silk, fleece, or any other fabric. In an additional preferred embodiment, the fabric of the head covering can be a disposable material such as polypropylene, or any other partial or completely synthetic or natural material that is easily disposed of. Head coverings made of these materials can also be non-disposable and reusable. In additional preferred embodiments, the fabric of the head covering may be pre-shrunk prior to construction so that it will maintain the proper size even after the user places it in the washing machine with other garments.

FIG. 1 shows one preferred embodiment of the head covering 10. In this embodiment, the cap portion 20 is shown with the pouch portion 30 connected on its posterior side. The cap portion 20 has a top surface 22, side panels 24, and a rear area 26. The pouch portion 30 is attached to the rear area 26 and has a cinchable border 32. In this preferred embodiment, the cinchable border 32 consists of a ribbon 34 passing inside an internal hem 36 along the edge of the cinchable border 32. When the ribbon 34 is pulled tightly, the pouch portion 30 will collapse into a "sack" or "pouch" shape in which the wearer's hair can be secured.

Figure 2:
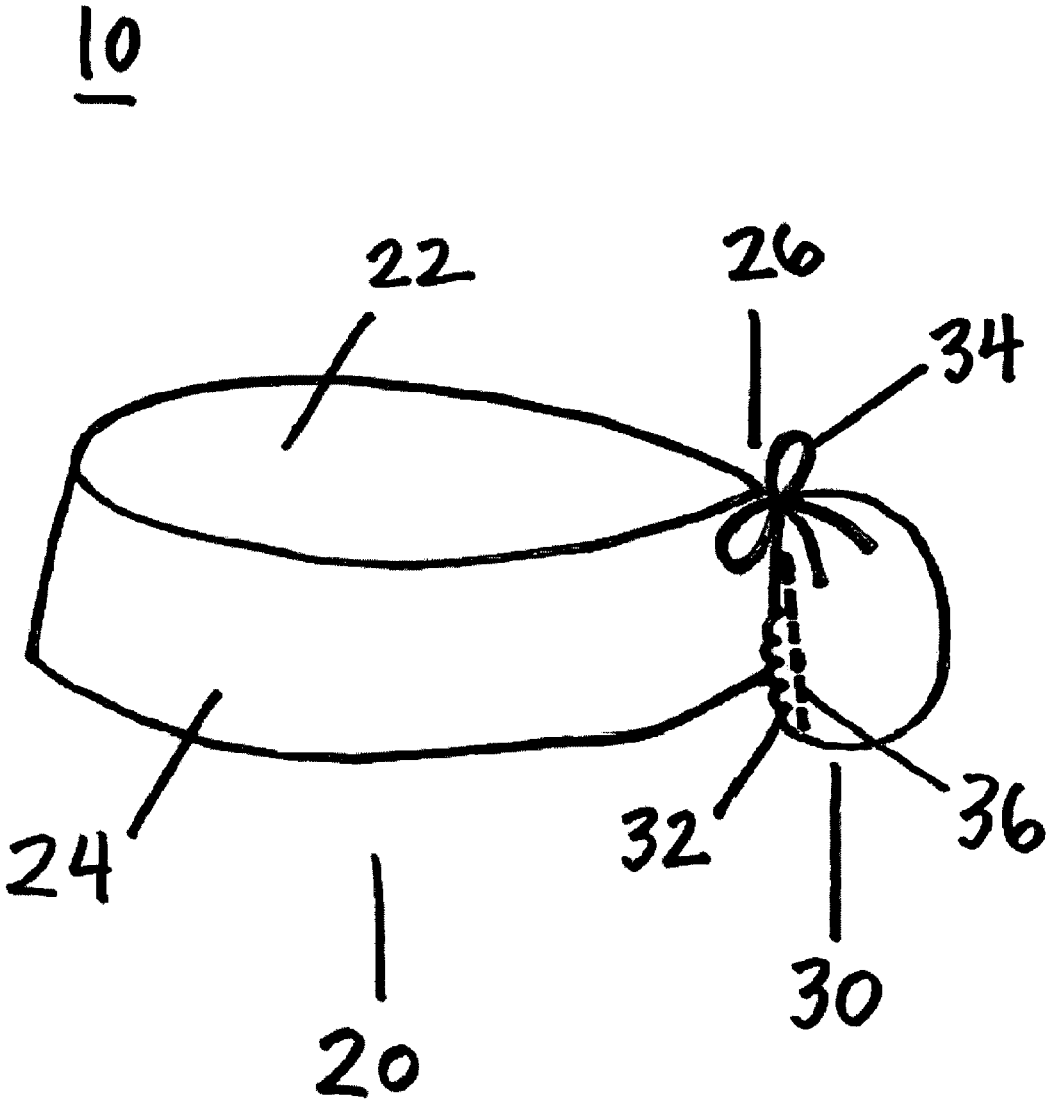
FIG. 2 is a side view of a modified head covering having a pouch portion that has been cinched to create a "pouch" shape.

FIG. 2 shows another preferred embodiment of the head covering 10. The cap portion 20 is shown to have a top surface 22, side panel 24, and rear area 26. In this embodiment, the pouch portion 30 of the head covering 10 has been cinched or tightened into a "sack" or "pouch" shape. A ribbon 34 that runs inside an internal hem 36 along the edge of the cinchable border 32 of the pouch portion 30 has been pulled tightly and tied over the top of the pouch portion 30. The cap portion 20 can be placed on a user's head, and the pouch portion 30 will conceal the user's hair. The tightly cinched "sack" or "pouch" shape can hold a great deal of hair, depending on how tightly it is drawn together. It will also keep the hair off of the nape of the neck.

Figure 3:
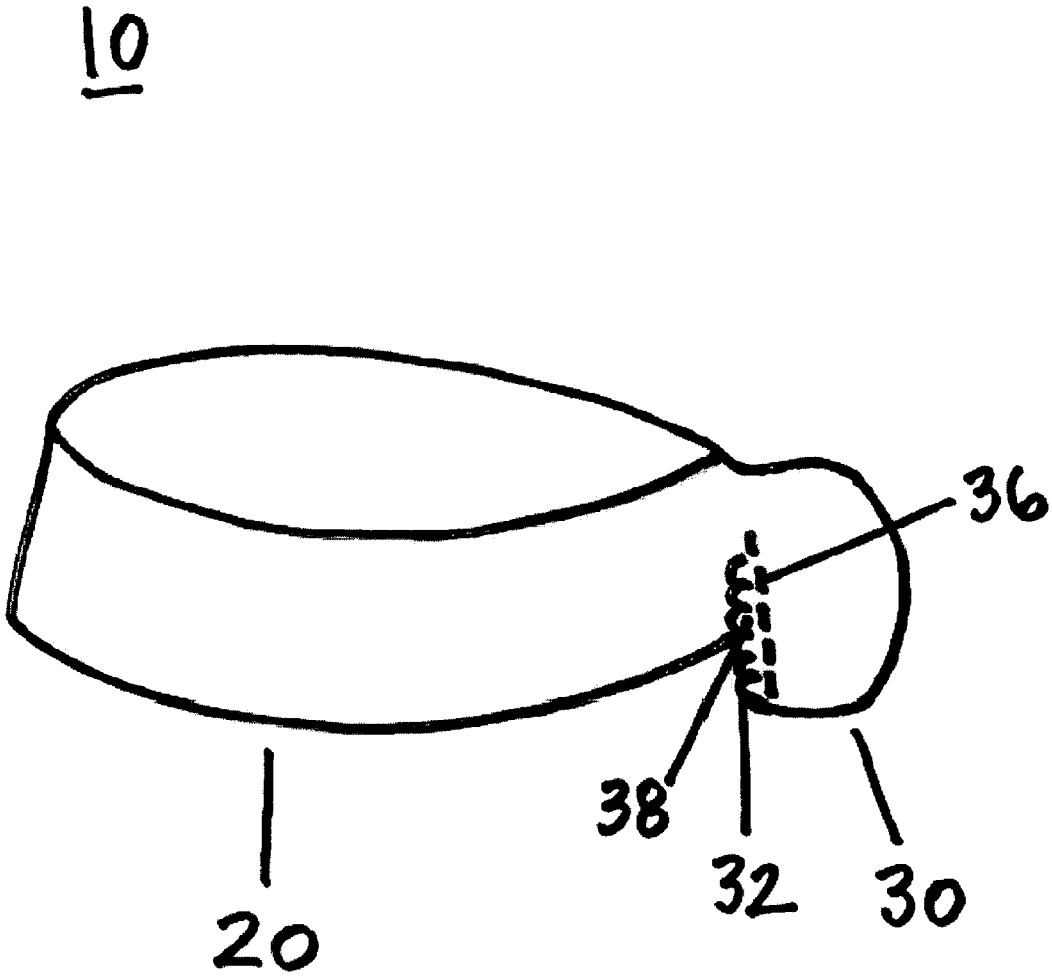
FIG. 3 is a side view of a modified head covering having a pouch portion with an elastic band.

FIG. 3 shows another preferred embodiment of the head covering 10, having a cap portion 20 and a pouch portion 30. In this embodiment, the pouch is formed by an elastic band 38 that passes inside an internal hem 36 along the edge of the cinchable border 32 of the pouch portion 30.

The embodiments illustrated in the accompanying figures are intended to represent examples only. Other embodiments of the head covering may be devised without departing from the spirit and scope of the invention.

What is claimed is:

1. A modified head covering for a user with long hair in a ponytail falling below the nape of the user's neck, comprising:

a cap portion, wherein the cap portion has a top surface, one or more side panels, and a rear area, and wherein the cap portion is specially fitted to a shape of the user's head; and a pouch portion attached to the rear area of the cap portion, wherein the pouch portion has a cinchable border and tightly collapses into a pouch shape to constrict and conceal the entirety of the long hair of the user at an elevated position above the nape of the user's neck, wherein the cinchable border comprises an internal hem and a ribbon passing inside the internal hem, and wherein the ribbon is crossed under the pouch portion and tied above the pouch portion to tightly collapse the pouch portion at the rear area of the cap portion to prevent hair from escaping, and wherein the pouch portion has a shape that mimics a shape of the ponytail of the user.

2. The modified head covering of claim 1, wherein the modified head covering is composed of a fabric.

3. The modified head covering of claim 2, wherein the fabric is cotton.

4. The modified head covering of claim 2, wherein the fabric is flannel, velvet, terry cloth, silk, or fleece.

5. The modified head covering of claim 2, wherein the fabric is polypropylene.

6. A modified head covering made from a fabric for a user with long hair in a ponytail falling below the nape of the user's neck, comprising:

a cap portion, wherein the cap portion has a top surface, one or more side panels, and a rear area, and wherein the cap portion is specially fitted to a shape of the user's head; and a pouch portion attached to the rear area of the cap portion, wherein:

the pouch portion has a cinchable border and tightly collapses into a pouch shape to constrict and conceal the entirety of the long hair of the user at an elevated position above the nape of the user's neck; and the cinchable border comprises an internal hem and a ribbon passing inside the internal hem, wherein the ribbon is crossed under the pouch portion and tied above the pouch portion to tightly collapse the pouch portion at the rear area of the cap portion to prevent hair from escaping, and wherein the pouch portion has a shape that mimics a shape of the ponytail of the user.

7. The modified head covering of claim 6, wherein the fabric is cotton.

8. The modified head covering of claim 6, wherein the fabric is flannel, velvet, terry cloth, silk, or fleece.

9. The modified head covering of claim 6, wherein the fabric is polypropylene.

* * * * *